US005192197A

United States Patent [19]

Culp

[11] Patent Number: 5,192,197

[45] Date of Patent: Mar. 9, 1993

[54] PIEZOELECTRIC PUMP

[75] Inventor: Gordon W. Culp, Van Nuys, Calif.

[73] Assignee: Rockwell International Corporation, Seal Beach, Calif.

[21] Appl. No.: 799,525

[22] Filed: Nov. 27, 1991

[51] Int. Cl.[5] ..... F04B 35/04

[52] U.S. Cl. ..... 417/322; 417/53

[58] Field of Search ..... 417/322, 53, 63

[56] References Cited

U.S. PATENT DOCUMENTS

| | | | |
|---|---|---|---|
| 3,150,592 | 9/1964 | Stec et al. | 417/322 |
| 4,688,536 | 8/1987 | Mitsuyasu et al. | 123/316 |
| 4,697,989 | 10/1987 | Perlov et al. | 417/322 |
| 4,780,062 | 10/1988 | Yamada et al. | 417/322 |
| 4,803,393 | 2/1989 | Takuhashi | 310/328 |
| 4,842,493 | 6/1989 | Nilsson | 417/322 |
| 4,939,405 | 7/1990 | Okuyama | 310/330 |

*Primary Examiner*—Richard A. Bertsch
*Assistant Examiner*—Charles G. Freay
*Attorney, Agent, or Firm*—H. Fredrick Hamann; Harry B. Field; David C. Faulkner

[57] ABSTRACT

An electric pump comprises a housing (22) that encloses a stack of waveplates (18) in which electrically created traveling waves forcefully move fluid (20) from an inlet duct (24) to an outlet duct (26). Each waveplate is made of shear type transducer material that is segmented by film electrodes, the electrode planes lying perpendicular to the direction of fluid flow. Electrode sets are stimulated by a multiphase electrical power source. The pressure at wave crest contacts is electrically controlled to hermetically trap fluid portions between waves, thereby achieving high throughput against high pressure differential. Rubbing is essentially absent throughout the pump, life shortening mechanisms being few and benign. High electromechanical efficiency obtains when waveplates are stimulated by electrically resonant frequencies. Pump variants include variable wavelength, variable wave amplitude, and tapered waveplates for improved effectiveness with compressible fluids. An increasing-wavelength variant is applicable to high specific impulse space propulsion. Other embodiments provide the functions of valves, filters, light modulators, microwave attenuators, fluid flow modulators grinders, x-ray imagers, and emulsifiers.

10 Claims, 2 Drawing Sheets

PIEZOELECTRIC PUMP

BACKGROUND OF THE INVENTION

1. Field of the Invention

The present invention is directed to pumps, and, more particularly, to piezoelectric pumps having a multiplicity of waveplates electrically undulated by shear transducer action.

2. Description of Background Art

The preponderance of known piezoelectric pumps use a stack of piezoelectric elements, each element deforming with 2-dimensional extension accompanied by a thickness deformation, the latter deformations producing a mechanical stroke that is the sum of the minute strokes of each element. Extensions and thickness deformations are inseparable. A stack of thickness elements is generally bonded to a rigid support means at one end, and is bonded to a rigid moving member such as a pump piston at the opposite end. Therefore, a bonded stack of thickness elements produces a stroke that is less than the stroke produced by a stack that is not rigidly bonded at its ends because a portion of the extension stroke is inhibited. The rigid bonding also causes internal shear and tensile strains in the stack.

Thickness stacks used in pumps generally use piezoelectric material of the ferroelectric type. The ferroelectric material is polarized in the direction of the applied electric field. If a reverse electric field is applied, the polarization will be reduced, destroyed, or reversed in direction, all of which reduce the performance of the piezoelectric elements. Therefore, thickness stacks are usually operated with monopolar electric potentials. Electric drive means that provide monopolar electric signals are more complicated than bipolar electric drive means because of the need for floating power sources. A thickness stack therefore produces half the mechanical stroke that would otherwise be available if both electric drive potentials and piezoelectric deformation were bipolar.

Known piezoelectric pumps use a piston or other displacement means to move fluid wherein the displacement means generally oscillates while at least two valves prevent most of the displaced fluid from moving in a direction other than the desired one. Typical of this class of pumps is a piezoelectric fuel injector by Takahashi, U.S. Pat. No. 4,803,393 in which piezoelectric action is transmitted hydraulically by means of a diaphragm or a bellows. The life of known pumps is shortened by rubbing at contacts between seals and sliding surfaces, between displacers and cylinders, and by fatigue of valves and, if used, of flexible membrane seals.

Known piezoelectric pumps store a large portion of the circulating energy in the form of elastic deformation of the pump body and in the mechanisms attaching the displacing means to the piezoelectric actuator stack. Additional energy is stored in the piezoelectric elements in the form of electric charge. These energies are generally only restored to the pump system between portions of the pumping cycles during which useful work is performed on the fluid. Energies that are not returned to the pump system but are dissipated as mechanical heat of friction or electrical heat of resistance operate with reduced electromechanical efficiency, and suffer a shorter life because of the accompanying higher operating temperatures. The pump drive means of Mitsuyasu, U.S. Pat. No. 4,688,536, charges piezoelectric elements in electrical parallel and discharges them in a sequence through inductive-capacitive circuits. Pump action is designed to be pulsatile and abrupt as required by the application of the invention to injecting fuel.

3. Objects of the Invention

An object of the present invention is the forceful movement of fluid from an inlet to an outlet without wear due to rubbing and with few and benign life-shortening mechanisms.

Another object of the present invention is pumping of fluid with high electromechanical efficiency obtained by electrically resonant activation. A further object of the present invention is the pumping of fluid without valves.

Another object of the present invention is higher speed of actuation by the direct action of apparatus components on the medium receiving the action, without resort to intermediary structural members. Yet another object of the invention is the acceleration of fluids to very high speeds for use in electromechanical propulsion.

An additional object of the present invention is controlling any combination of fluid flow, inlet pressure, and outlet pressure by a valve action, and the maintenance of a valve state without further input of electrical power.

A further object is fluid filtering wherein the upper limit of size of passed particles is continuously controllable electrically, and the maintenance of a filter state without further input of electrical power.

Additional objects of the filtering function of the present invention is a self-rinsing filtering action and electrically controlled particle sorting.

Still another object of the present invention is emulsification of quiescently immiscible fluids such as oil and water, and the disruption of agglomerated two-phase fluids such as flocculates and biological cells.

The object of a variant emulsifier is more efficient action by superposing ultrasonic signals on the emulsifying signals. Still yet another object is electrical control of short electromagnetic waves.

Another object is electrical power generation of the pump embodiment by the transduction of fluid power to electrical energy. Another object is the modulation of an optical beam.

A further object is the imaging of x-rays by electrically figuring grazing incidence mirrors.

Another object is the application of the present invention to grinding.

Other objects, advantages and novel features of the present invention will become apparent from the following detailed description of the invention when considered in conjunction with the accompanying drawings.

SUMMARY OF THE INVENTION

The piezoelectric pump forcefully moves fluid in a positive displacement fashion. Each of a multiplicity of waveplates is resonantly electrically but not necessarily mechanically excited by a multiplicity of electrical phases. The electrical phases generate traveling waves. The waveplates are arranged to touch at wave crests. The fluid in the volumes between wave crests is carried along with the movement of the waves. Contact or near-contact between wave crests enhances the positive displacement function of the pump but without rubbing friction as all waves, at a given instant and location, travel with the same speed. Wave crest contact pressure is electrically controlled in accordance with the momentary needs of pump pressure differential (head). The moving trapped volume, the number of volumes, and the speed of wave motion determine, in the absence of leakage, the pumping capacity of the device. Sensors internal to the pump allow better control by an electrical controller. The pump operates in reverse as an electrical power generator. Pumps operated with slowly varying electric signals serve as valves, flow controllers, back-pressure regulators and the like. Suitably coated waveplates also function as grinders, self cleaning and electrically controllable particle filters, emulsifiers, microwave controllers, optical modulators, and imagers of x-rays.

DETAILED DESCRIPTION

Figure 1:
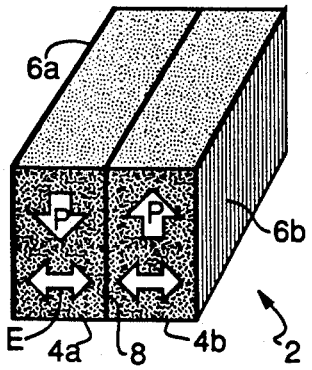
FIG. 1 is a perspective drawing of a preferred embodiment of an element of the present invention.

Referring to FIG. 1, shown is a fundamental building block of the present invention called a dimorph. In this embodiment dimorph 2 comprises a piezoelectric body divided into two portions 4*a*, 4*b*, by central film electrode 8 and external ground film electrodes 6*a*, 6*b*. Application of a bipolar, preferably symmetric electric waveform to active electrode 8 creates electric fields E in bodies 4*a* and 4*b*. The piezoelectric body portion 4*a* is polarized P antiparallel to that in body portion 4*b*.

Figure 2:
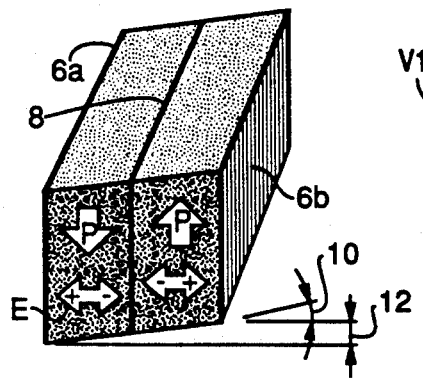
FIG. 2 is shows the electromechanical response of the element of FIG. 1.

FIG. 2 is the dimorph of FIG. 1 at an instant when the applied electric field, E, is present with polarities indicated by + and −. The shear deformation of the dimorph by angle 10 and translation of electrode 6*b* relative to electrode 6*a* by stroke 12 is the result of the applied electric fields E. At another instant of time, the reversal of the polarity of the applied electric fields is accompanied by piezoelectric deformation angle 10 and translation 12 in directions opposite those shown in FIG. 2. The other measures of the size of the dimorph remain constant, being independent of the state of shear deformation. Neither the distance between ground electrodes, the length measured perpendicular to the plane of the figure, nor the height measured in the direction of polarization, change during shear deformation. In addition, the volume of the dimorph remains essentially independent of the state of deformation. The shear dimorph allows operation by a voltage-symmetric electric source without depolarizing even ferroelectric materials, thereby affording essentially twice the mechanical stroke per unit of applied electric field intensity compared to the thickness or extension piezoelectric deformation modes. Further, the coefficient of transduction for shear, $d_{15}$, and the electromechanical coupling factor are generally higher than for other deformation modes, thereby further enhancing performance. The advantages of the properties of shear dimorphs will become apparent with additional detailed description.

Figure 3:
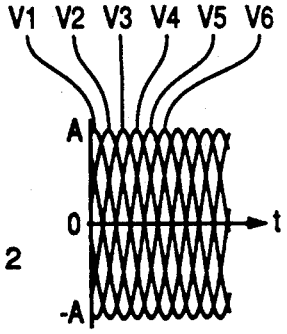
FIG. 3 is a plot of a multiplicity of electrical stimuli, each having a unique phase, as a function of time.
Figure 4:
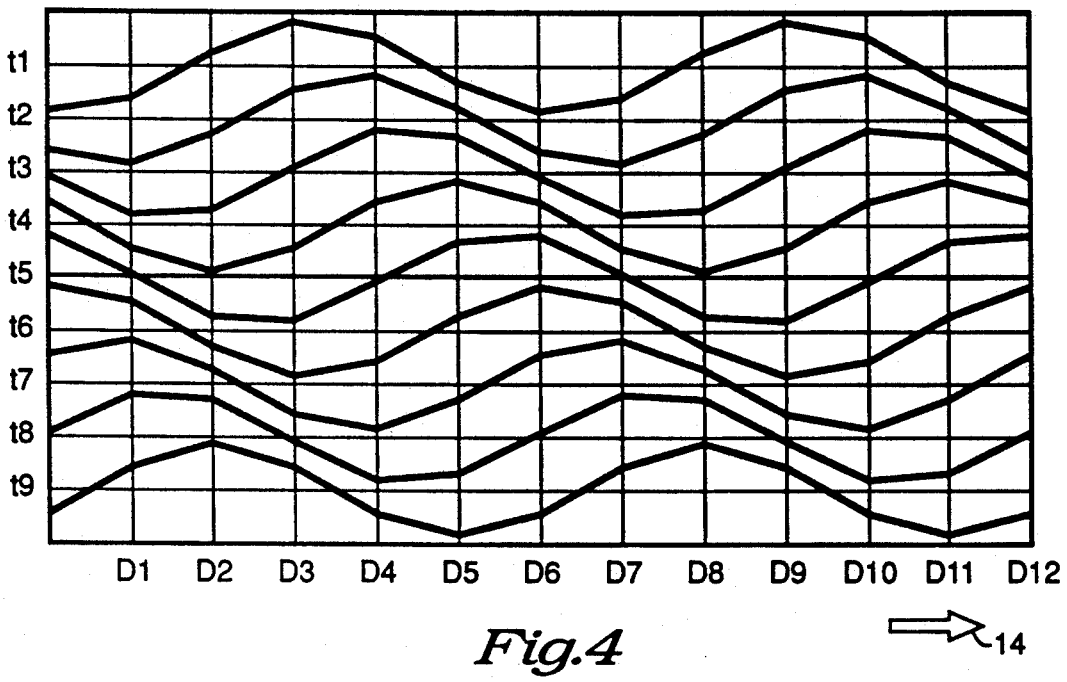
FIG. 4 is a time-animated sequence of pump plate edges.
Figure 5:
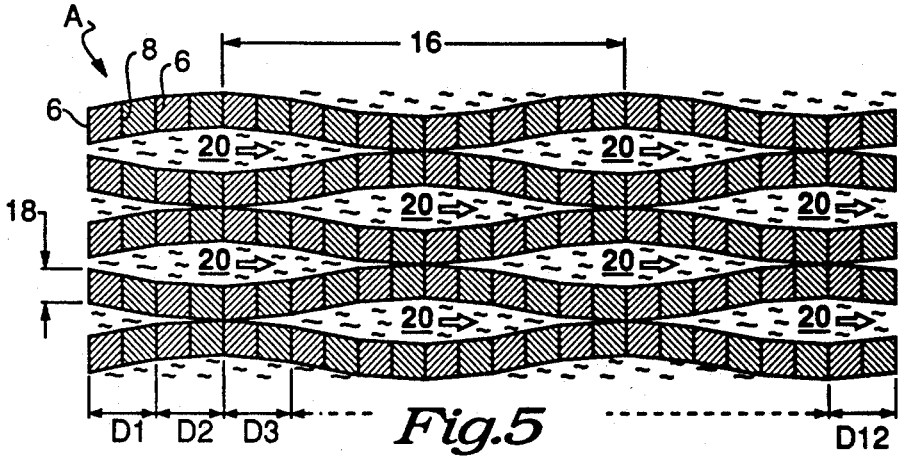
FIG. 5 is a partial cross section drawing of a preferred waveplate embodiment in the act of pumping.

FIG. 3 shows a six-phase set of electric potentials V1 . . . V6 of amplitude A plotted as functions of time t. FIGS. 4 and 5 illustrate the effect on a sheet of dimorphs joined by common ground electrodes, hereinafter called a waveplate, said dimorphs respectively connected modulo-six to the potentials of FIG. 3.

FIG. 4 is an animated sequence t1 . . . t9 of the positions of dimorphs D1 . . . D12 of the modulo-six waveplate of FIG. 5. The heavy trace is the locus of dimorphs edges (for example, edge 4 of FIG. 1), each trace segment having a slope that is proportional to the product of the instantaneous electric potential and the shear piezoelectric constant $d_{15}$.

FIG. 5 is a cross section view of a stack of waveplates A immersed in fluid 20. Each wave plate comprises many dimorphs 2 joined by common ground electrodes 8. Waveplates are arranged to alternate with polarization directions up and down. At the instant of time of the figure, potential V1 obtains in dimorph D1, V2 in D2, and so forth. Dimorphs are connected modulo-six in the example of the figure, giving a wave period 16. Electrical connections are omitted for clarity. Since the volume of an isolated dimorph does not change with varying applied electric potential, an isolated dimorph cannot affect the fluid other than to rearrange it. However, when dimorphs are joined into waveplates as shown, the shear deformation of one dimorph translates the attached adjacent dimorphs vertically in the figure. The net vertical displacement of the adjacent dimorphs result in a net fluid displacement. In other words, waveplates in contact or near contact at their wave crests enclose segments of the immersing fluid. By dint of the electrical phases of FIG. 3 and the traveling of waves in direction 14 of FIG. 4, the segments of fluid 20 are translated in the direction indicated by the arrows. The entrapped volume of each fluid segment remains essentially constant during the movement of shear waves as depicted in FIG. 4.

Each waveplate has a constructed thickness 18, but waveplates are arranged equally spaced by a distance greater than thickness 18 to include the peak-to-peak amplitude of the waves. The wave amplitude is the sum of the shear strokes taken over half of the period 16 and is electrically controlled by unison variation of the amplitudes A of potentials V1 . . . V6 of FIG. 3.

Figure 6:
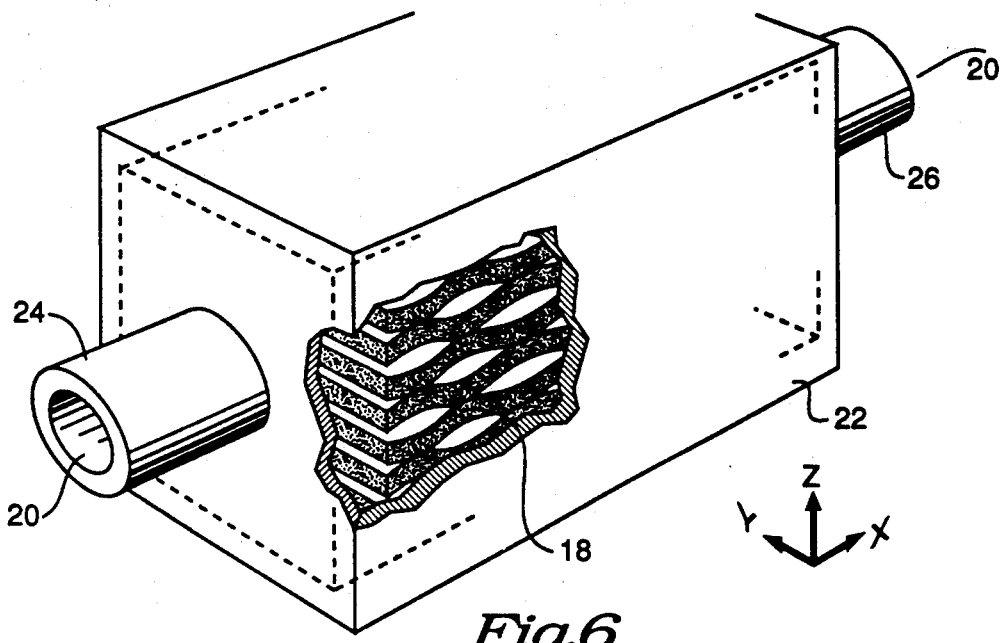
FIG. 6 is a phantomed, cut-away perspective view of the present invention in the act of pumping.

FIG. 6 is a partially phantomed cutaway perspective view of an embodiment of the piezoelectric pump comprising waveplate stack 18 in housing 22. Fluid inlet and outlet 24, 26 permit the passage of fluid 20 through the pump. In accordance with the illustrated coordinate system, dimorph electrodes (omitted from the figure for clarity) lie parallel to y–z planes, fluid flows in direction x, and wave crest contact forces are controlled in direction z.

Figure 7:
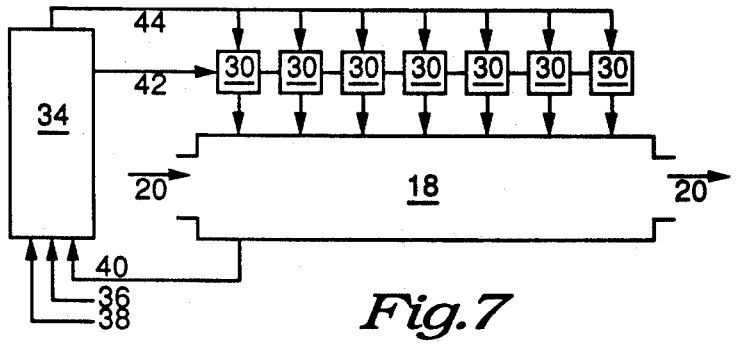
FIG. 7 is a simplified schematic diagram of the system of the present invention including electrical drive means.

FIG. 7 is a simplified schematic system control diagram for the piezoelectric pump, comprising pump 18, controller 34, resonator components 30, source of electrical power 36, and a source of external operating commands 38. Controller 34 distributes electrical power 44 and control signals 42 to resonating components 30 in accordance with operating instructions 38. In a preferred embodiment, each set of active electrodes of dimorphs that lie in a vertical y-z plane (FIG. 6) are connected together and are connected to a corresponding resonating component 30. Each said set is stimulated to electrical but not necessarily electromechanical resonance with a predetermined phase and amplitude. Controller 34 maintains the wave propagation in waveplate stack 18. Optionally, state sensors internal to the waveplate stack 18 or its housing provide state signals 40 to controller 34 in order to better match the performance of the pump with the requirements of the operating instructions 36. Such state sensors include but are not limited to temperature sensors, pressure sensors, flow sensors, contact pressure sensors, fluid velocity sensors and the like. A preferred sensor comprises one or more dimorphs of a waveplate that are independently electrically connected to controller 34. Since dimorphs are electromechanically reciprocal, the electrical signal on the sensor dimorph is a measure of the state of stress on that dimorph, said state being easily related to one or more pump performance parameters that are used by the controller. A variant of the dimorph sensor is a sensor using only a portion of a dimorph, the active electrode being bifurcated at a predetermined location, and thereby allowing a prescribed portion of the dimorph to participate in fluid pumping.

Figure 8:
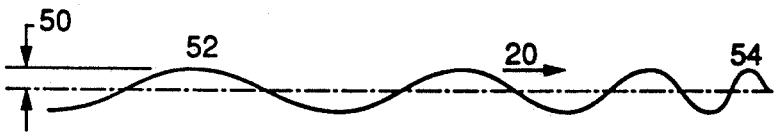
FIGS. 8, 9, and 10 show variations of driving the present invention to accommodate particular pumping requirements.

FIG. 8 is a plot of a traveling wave in the piezoelectric pump having constant amplitude 50, travel direction 20, and wavelength that changes progressively in direction 20 such that fluid segment volume, hereinafter called cell displacement, at 52 is greater than at 54. The quotient of cell displacement 52 and cell displacement 54 is referred to as the compression ratio. The pump has a fixed compression ratio when the connections of FIG. 7 are made to dimorphs groups, each group connecting a progressively fewer number of dimorphs in direction 20.

The variant of the system controller of FIG. 7 having a matrix switch allows instantaneous reconnection of dimorphs into a variety of resonating phase groups, thereby allowing electrical control of the compression ratio and shape of the pressure gradient in the pump. Variable cell displacement allows the pump to maintain a predetermined cell pressure despite leakage when incompressible fluid is pumped. When compressible fluids such as gas are pumped, the progressive compression ratio allows control of the rate of compression, the initial, and the final pump operating pressures. Constant wave amplitude 50, also electrically controlled, allows a fixed housing dimension in the z direction (FIG. 6).

Figure 9:
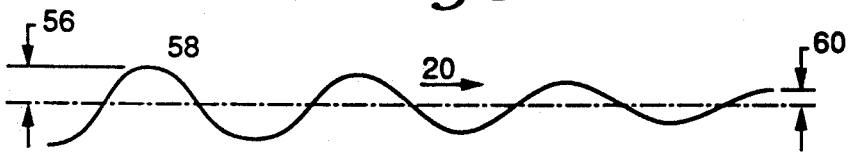

FIG. 9 is a plot of a traveling wave in the piezoelectric pump having a constant period 58, and a linear taper of amplitude from a large amplitude 56 to a small amplitude at 60. The crest envelope of each waveplate thus excited is a wedge shape, therefore requiring a housing 22 that tapers in z from inlet 24 to outlet 26 (FIG. 6). The taper is fixed once made, but is not restricted to a linear taper. The taper of amplitude affects a compression of fluid similar to the arrangement of FIG. 8.

Figure 10:
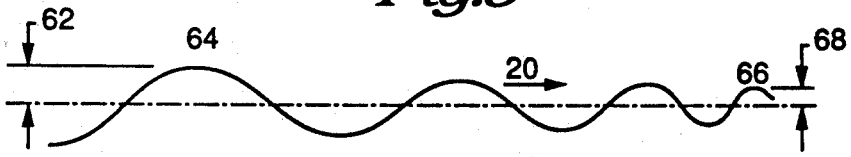

FIG. 10 combines amplitude taper from 62 to 68 and period taper from 64 to 66 to achieve a greater compression ratio than otherwise available using either taper alone.

An alternate embodiment of the pump employs a y housing taper from inlet to outlet to alter compression ratio. Other embodiments use any combination of the foredescribed tapers to provide a predetermined fluid compression and rate of compression.

It is to be understood that reversing the sign of the electrical phases, or equivalently, reversing the order of the phases, reverses the direction of fluid pumping.

The advantage of operating each y-z-plane set of dimorphs at resonance is reduced controller operating voltage, and greater operating efficiency. In a preferred transformer embodiment of the resonating component 30 (FIG. 7), the low-voltage primary winding of the transformer is driven by solid state circuitry that operates with greater efficiency and reliability at low voltage and relatively high currents. The secondary of the transformer is connected in a loop with the essentially completely capacitive reactance of the dimorph set. The loop is tuned to electrical but not necessarily electromechanical resonance. At or near resonance, relatively high oscillating potentials are stimulated in the waveplates. Accompanying the high peak potentials are relatively large circulating reactive currents. The large circulating currents, temporarily stored in the dimorphs, are largely returned to and reused by the system each cycle. The loop resistance in preferred practice is made small in order to restrict the resistive dissipation of electrical power to a value below a desired level.

It is clearly shown in FIG. 5 that the use of sine electrical waves and the resulting straight line segment approximation of sine curves made by the dimorphs of the waveplates does not provide the greatest possible pump throughput. A waveplate waveform such as a trapezoid would increase the cell displacement over that available when sine waves prevail. A variant of controller FIG. 7 replaces the previously described resonating components 30 with switch matrices. The switches, operated by controller 34, rearrange connections between dimorphs or dimorph groups and separate sources of a variety of fixed-value potentials. A predetermined arrangement of switch states provides essentially any waveplate waveform allowed by the shear deformation capabilities of the constituent dimorphs. The direct current matrix switch control method proffers relatively great operational flexibility, but does not achieve the high efficiency as does the method of multi-phased resonance stimulation previously described because electrical charge is not stored and reused in as effective a manner.

It is also to be understood than the pressure of contact between crests of waves of proximate waveplates is electrically adjustable. When the pump operates against a difference between outlet and inlet pressures, the pressure internal to the pump tends to force the crest contacts apart, thereby increasing leakage and retrograde flow. The controller, using pressure sensors, increases the electrical amplitude, but not necessarily the stroke amplitude of the wave crests in order to maintain retrograde fluid flow to a level lower than a prescribed amount. The energy consumed by the pump during operation is therefore somewhat dependent on the pumping conditions, the advantage being the use of less energy when pumping conditions are less demanding.

The practice of the present invention entails the use of waveplate edge seals, lead insulation, and electrically insulating coatings for the waveplates. Encapsulation of waveplate edges comprises elastomers when the pumped fluids are compatible therewith. Only enough elastomer is used to provide shear compliance between waveplates and the housing wall. The elastomer seal also encapsulates and protects electrical leads. More chemically active fluids are handled by labyrinth or honed proximate waveplate edge surfaces. Low viscosity fluids require relatively small waveplate edge clearances that are maintained by selecting housing materials that match the linear thermal expansion properties of the waveplates. Insulating layers are applied to all surfaces of waveplates that operate immersed in electrically conductive, corrosive, or otherwise ionically active fluids.

An advantage of connecting dimorphs in y-z planes (FIG. 6), wherein waveplate polarization directions alternate waveplate to waveplate, is that active dimorph electrodes, particularly those electrodes at or near wave crest contacts, remain at essentially the same electrical potential even though the magnitude of the potential may be relatively high. Proximate active electrodes, having the same potential, have essentially no tendency to initiate dielectric breakdown in the pumped fluid, or, if used, in the electrically insulating coatings on the waveplates. Another advantage of the aforedescribed dimrph connections is, given a predetermined uniformity of dimorph electromechanical response, that no rubbing occurs at wave crest contacts. Therefore, the use of elastomer or controlled-clearance waveplate edge seals, in combination with frictionless wave crest contacts, virtually precludes frictional wear as a life shortening mechanism. It appears in the figures that sharp edges are in contact at wave crests. This is due to the relative coarseness of waveplate electrical segmentation used to provide clarity of the figures. In practice, tens to hundreds of dimorphs operate in each moving fluid cell of the pump, thereby providing a sufficiently accurate approximation of a smoothly curved surface that sharp edge contact is avoided.

As an example, an embodiment of a liquid pump having constant wave amplitude and constant wavelength, uses ferroelectric piezoelectric material with a shear coefficient $d_{15}$ of 2.0 nm/volt and a maximum applied electric field intensity E of 20 kV per [cm]. Piezoelectric layers are 0.10 mm thick, making dimorphs 0.20 mm in size in the flow direction (x, FIG. 6). Waveplates are 0.76 mm thick (z direction), 140 of which are contained in a housing 110 mm square (y, z) by 61 mm (x). One hundred dimorphs are connected to 100 corresponding resonant stimulating circuits having phases differing by $2\pi/100$ radians. Each wave has a length of 20 mm, allowing three cells along the x flow direction. The displacement (volume delivered per pump cycle) of the pump is 0.057 cu.cm (volume of 140 cells in a y-z plane). Waveplates are arranged on 0.79 mm centers, a distance that accommodates the 0.76 mm waveplate thickness and 0.025 mm wave p—p amplitude when excited to a peak voltage of 200 volts. This example pump passes approximately 3780 liters per minute when the resonance frequency is 8 kHz (disregarding crest-contact leakage). This example pump uses elastomer edge seals. Internal to the elastomer are cavities that fill with the pumped fluid via connecting conduits (not shown in figures) in order to balance the hydrostatic pressure in the area of the seals. The weight of this example pump, not including the weight of the electrical drive means, is approximately 12 kgr, comprising 5.5 kgr of waveplates and 6.5 kgr of housing. It is to be understood that this example uses a well known piezoelectric material (PZT-5H) evincing altogether ordinary electromechanical responsivity, and that substantially greater performance is expected when advantageous materials are substituted.

The pump of the present invention encompasses a diverse class of pumping devices in which construction and operational parameters are varied to suit particular applications. It is to be understood that the detailed description is couched in terms of piezoelectric shear transducer material by way of example, whereas the use of any transducer material that produces an electromechanical action equivalent to that of the hereindescribed piezoelectric shear transducer material is considered to be within the scope of the present invention.

Practice of the invention requires the use of grillages or porous members (omitted from figures) to support the inlet and outlet edges of waveplates against the forces of pumping, while allowing unrestricted fluid flow. Edge support includes elastic compliance sufficient to allow essentially unconstrained waveplate motion. Despite appearances, the relatively thin waveplates exert a relatively high fluid pressure during pumping without failure due to excess stress because wave amplitudes are relatively small and because pumping pressures are essentially completely canceled internal to the pump. Small wave amplitudes, typically a few per cent of the thickness of the waveplates, maintain the waveplates in a nearly flat condition. Nearly flat waveplates bear an edge-on hydrostatic pressure of pumping by placing the entire waveplate in compression. Of all physical strength properties of the brittle ceramics typically used for piezoelectric transducers, the compressive strength is by far the greatest.

Pump embodiments of the present invention operate as bidirectional pumps, the flow direction being reversed with the sign of each electrical phase is reversed, or equivalently, when the order of phase application is reversed.

Variants of the pump having progressively greater cell lengths and progressively smaller cell volumes use tenuous fluids for propulsion in deep space. The pump of the present invention is a positive displacement pump in the sense that a trapped volume of fluid is confined and propelled by the trapped fluid volumes, independent of changes of speed and pressure. Progressively greater cell lengths are conveniently made by progressively increasing the number of dimorphs that operate from the same electrical stimulus. As is well known, very high group velocities are achieved with commonly used frequencies when wavelengths are increased to relatively large values. Neglecting aerodynamic drag and boundary layer effects, packets of gas may be mechanically accelerated to very high velocities using the present invention.

The last few groups of dimorphs near the exit end of a propulsion embodiment may have a direct current superimposed on the alternating current drive signal. The direct current component causes a net departure of the exit portion of the pump from straight. The transverse deflection of the exiting fluid path affects steering by electrical thrust vector control. A transition duct with a quarter turn about the x axis (FIG. 6) may direct a portion of the exiting fluid to a second outlet, thereby affording two-axis thrust vectoring. In addition to maintaining the passage of the thrust vector through the center of mass of a space vehicle, higher frequency components are added to the vectored thrust to cancel thrust-generated vibrations in the vehicle's structure.

The electrical power generator embodiment of the present invention does not require modification of the device itself. A combination of kinetic and potential energy borne by a fluid passing through the device is converted to useful electrical power when the fluid accentuates the amplitudes of waveplate undulations. The controlling means maintains resonance and phase coordination of waveplates, while extracting all electrical energy that exceeds the input from the controller. Electrical power generation is particularly effective when waveplates are constructed of essentially completely electromechanically reciprocal transducer materials, such a piezoelectric shear dimorphs. Complete reciprocity, accompanied by negligible electrical and mechanical losses permit conversion of fluid-borne energy to electrical power with relatively high efficiency. As in the case of the pump embodiment of the present invention, the generator embodiment does not cause wave crests to rub, thereby providing a generator life that is shortened by few and benign mechanisms.

The present invention also functions as an electrically controlled valve. The effective orifice of the valve is easily varied from wide open when excitation voltage is zero, to completely closed when crests of waveplates are pressed together at maximum voltage. Valves tolerant of a small amount of leakage are made with at least one closable pair of wave crests. Valves with relatively complete sealing are made with enough wave crests pressed together to constitute a labyrinth seal. A wave crest may consist of one or more pairs of broad surfaces of proximate dimorphs in forceful contact, the planar contact offering advantageously greater resistance to fluid leakage than an edge-to-plane contact.

Wave crests are coated with malleable metal or resilient material in embodiments requiring a complete seal. The malleable metal sealing coating facilitates sealing in high vacuum valves. An advantage of the embodiment of the present invention using piezoelectric shear dimorphs and slowly varying direct current activation is that the shape of waveplates, once established by the placement of a prescribed amount of electric charge, remains until the quantity of charge is intentionally changed, or until the charge autodischarges through the known high but finite electrical resistivity of the piezoelectric material. Even allowing for autodischarge, the electrical energy requirements for a valve that is adjusted at a leisurely pace are essentially insignificant.

An alternate function of the piezoelectric pump is use as a pressure, flow, and mass flow controller. The previously described electrical control of wave crest contact pressure is used to control crest clearance. When zero potential remains, each waveplate assumes its quiescent planar shape, thereby offering the least resistance to the passage of fluid, namely, a wide-open state. Any flow area from wide open to zero area is therefore electrically controllable. Sensors allow the controller to maintain a variety of states such as predetermined upstream pressure, prescribed downstream pressure, a desired flow velocity, and a useful mass flow of fluid. Flow and pressure control may also be used in any combination with the other actions of the present invention.

The present invention operates as a filter wherein the sizes of the fluid passages between waveplates are adjustable electrically. The range of particle sizes trapped by the filter is adjusted from essentially zero diameter at maximum voltage to maximum diameter when zero voltage is applied. Trapped particles are easily released when the applied voltage is momentarily made zero. A variant of the filter embodiment sorts particles by connecting a valve embodiment in the fluid stream line and another valve in a fluid branch between the line valve and the filter. For example, after collecting particles of a certain size for a predetermined time interval, the line valve is closed and the branch valve is opened, after which the filter is self-cleaned by momentarily setting its voltage to zero (or eliciting pumping action). The batch of filtered particles is then passed from the filter to the branch, thereby affecting a first step in the method of sorting particles by size. Other configurations of the present invention incorporate valve, flow regulator, and filter functions into the same device by adding valved ports, also called fluid taps, at prescribed intervals along the flow path, constituting analogs to certain biological fluid functions such as those found in the mammalian kidney.

The present invention functions as an emulsifier when wave crests are separated by a prescribed distance, and the wave propagation directions in even numbered waveplates are opposite to the propagation directions in odd numbered waveplates. Waves traveling in opposite directions impose an electrically controlled amount of fluid shear in each displacing cell. Fluid between waveplates is not trapped in the sense of trapping in the positive displacement pump embodiment, but fluid is sufficiently confined to render the fluid shearing action adequate to emulsify many combinations of quiescently immiscible fluids such as oil and water. When the wave propagation speed of one waveplate set differs from the other set, the emulsifier combines the action of pumping previously described with the action of emulsifying. The emulsifying action of the present invention is also applicable to the disruption of biological tissue and agglomerates. A variant of the electric drive means of the emulsifier superposes a high frequency signal on the normal drive signals to add an ultrasonic component to the wave motion. The ultrasonic component, at least in piezoelectric shear dimorphs, is efficiently transduced into the passing fluid, thereby enhancing the emulsifying and disbursing action of the waveplates.

A grinding embodiment of the present invention uses the electrically controlled and undulated clearance between waveplates to crush large particles into smaller fragments, for example, as is commonly done with pigments. The peristaltic action of the waveplates provides a grinding action similar to a gyratory crusher, an action that is distinguished from that of the sliding of a grinding member past another proximate grinding member. Grinding embodiments may have an abrasion resistant coating applied to waveplates and other surface portions in contact with the ground medium. Grinders may have fineness stages within an integral waveplate structure, and alternatively may have fineness stages in separately housed waveplate sets in any combination of main stream and branch stream valves of the present invention. It will be noted that filtering, valving, and pumping action are inherent in the grinder and are used in any combination prescribed by a particular application.

An embodiment of the present invention having electrically conducting coatings on waveplates (insulation internal thereto) functions as an electrically activated control means for the passage of high frequency electromagnetic waves, such as microwaves. For example, the waveplate edges at a waveguide branch may serve as a power divider wherein a portion of the incoming wave passes to a branch and the remainder of the wave passes between the waveplates. The magnitude of the divided portion is controlled by varying the spacing between wave crests. In addition, the waveplate edges on which the microwaves first impinge, a relatively responsive area, may be arranged in a desired pattern by predetermined changes of potentials applied to the waveplates. A closed end variant of the present invention is appended to a resonant electromagnetic cavity, allowing remote electrical tuning.

An attenuating variant of the microwave controller has waveplates coated with material having a prescribed dielectric constant and absorptivity. By remote control, waveplate edges and wave crest spacing are electrically rearranged to alter microwave transmission and reflection properties. Advantageously, microwave electrical properties may be affected in approximately one tenth of the time required by an equivalent electromagnetic (solenoid and plunger) actuator, and in even less time when electrical energy temporarily stored as charge in the wave plates is suddenly released or mutually annihilated.

A variant of the present invention having waveplate surfaces coated with optical materials provides the functions of collimation, attenuation, and spatial information encoding. The collimation function is provided when the optical coating is reflective, and the spaces between waveplates serve as optical wave guides analogous to optical fibers. Application of a prescribed set of voltages to the waveplates causes each waveplate to approximate a smooth curve, allowing the waveplates to collectively constitute a cylindrical lens. Metal coated waveplates may be arranged into a nested set of parabolic single or multiple grazing incidence mirrors for x-ray imaging. Two sets of waveplates, one following the second and rotated about the optical axis by one quarter turn, approximate a circular lens for full imaging capability. Two more sets of waveplates, electrically curved to approximate hyperbolas, further refine the focused image from the parabolic waveplates, a combination known to achieve greater image resolution than either one used separately.

Light modulators with relatively fast response are constructed with thin waveplates. Such modulators require waveplates to exert no force other than that arising from the inertial force of reaction to accelerating during rearrangement from one optical transmission level to another. WAveplates may have predetermined incidence edge treatment to reduce reflection and absorption, for example, during Q-switching of a high power laser. In addition, waveplates may be cooled by passing fluid through internal ducts.

A method of assembly of dimorphs into waveplates is the use of diffusion bonding of common metal ground electrodes. When true piezoelectric materials (intrinsically polarized) are used, diffusion bonding is generally affected at relatively high temperatures. With the lower-coercive-force ferroelectric materials, elements are shear polarized with temporary electrodes, metallized, then diffusion bonded at relatively low temperatures but with correspondingly longer bonding times and higher pressures. The preferred method is the alternating tenous deposition of metal electrodes and deposition-polarized transducer material, followed by slicing into waveplates.

It is also clear that a single waveplate may be joined to another similar waveplate in order to enhance the pumping and general forcing capability of such joined, said performance being greater than either waveplate used alone. Two waveplates bonded with wave directions perpendicular constitute a deformable mirror, the forces in which are predominantly shear, all other forces being of such low influence as to be virtually negligible.

Obviously, many modifications and variations of the present invention are possible in light of the above teachings. It is therefore to be understood that, within the scope of the appended claims, the invention may be practiced otherwise than as specifically described.

What I claim is:

1. A pumping method comprising:

assembling a pump comprising a housing defining a fluid flow-through internal cavity; at least one flexible waveplate disposed within said housing which waveplate further comprises shear transducer material that is planarly electrically segmented with film electrodes, said electrodes having broad planes perpendicular to a direction of a fluid flow; a housing fluid inlet communicating with said internal cavity; a housing fluid outlet communicating with said internal cavity; and a phased multiple-output controller associated with said waveplate;

further configuring said pump such that of the electrodes, some are even numbered and are electrically grounded and some are odd numbered, all odd numbered electrodes connected to a source of electrical power controlled by said controller;

funtioning said odd electrodes with a corresponding phase of electrical power from an electrical power source;

causing said shear transducer material to selectively shear in response to an electrical signal;

creating a trapped volume of fluid by said waveplate shear through the induction of fluid through said fluid inlet and into said cavity;

transporting said fluid by further waveplate shear to said outlet; and expelling said fluid from said pump outlet.

2. The method of claim 1 further comprising the step of using piezoelectric material in said waveplate.

3. The method of claim 1 further comprising the step of using electrostrictive material in said waveplate.

4. The method of claim 1 further comprising the step of using electromagnetic material in said waveplate.

5. The method of claim 1 further comprising the step of using electroexpansive material in said waveplate.

6. The method of claim 1 further comprising causing said shear transducer material to shear such that shear wave amplitude modifies in the direction of fluid movement.

7. The method of claim 1 further comprising selectively controlling wave width, amplitude and length in the direction of fluid movement.

8. The method of claim 1 further comprising providing sensors internal to said cavity which sensors monitor pump function in cooperation with said controller for modifying pump operation.

9. A pump comprising:

a housing defining a fluid flow-through internal cavity;

at least one flexible waveplate disposed within said housing further comprising shear transducer piezoelectric material planarly electrically segmented with film elecrodes, said electrodes being in a plane perpendicular to fluid flow within said cavity;

a housing fluid inlet communicating with said internal cavity;

a housing fluid outlet communicating with said internal cavity; and a phased multiple-output controller associated with said waveplate.

10. A pump comprising:

a housing defining a fluid flow-through internal cavity;

at least one flexible waveplate disposed within said housing further comprising shear transducer piezoelectric material planarly electrically segmented with film electrodes, said electrodes being in a plane perpendicular to fluid flow within said cavity;

a housing fluid inlet communicating with said internal cavity;

a housing fluid outlet communicating with said internal cavity;

a phased multiple-output controller associated with said waveplate; and means for effecting movement of said waveplate in a determined combination of width, wave amplitude, wave length and direction.

* * * * *